United States Patent [19]

Lindsay et al.

[11] Patent Number: 5,028,192

[45] Date of Patent: Jul. 2, 1991

[54] BINDING AND COLLATING TECHNIQUES

[75] Inventors: Robert J. Lindsay, Duluth; Rodney E. Bell, Wilburn; William McNickle, Marietta, all of Ga.

[73] Assignee: Foote & Davies, Inc., Atlanta, Ga.

[21] Appl. No.: 349,864

[22] Filed: May 10, 1989

Related U.S. Application Data

[63] Continuation-in-part of Ser. No. 220,782, Jul. 15, 1988, abandoned.

[51] Int. Cl.[5] ..... B42C 1/00

[52] U.S. Cl. ..... 412/1; 412/9; 412/33; 270/54; 270/58

[58] Field of Search ..... 270/36, 37, 54, 58; 412/1, 2, 8, 9, 16, 11, 19, 25, 33, 37

[56] References Cited

U.S. PATENT DOCUMENTS

| | | | |
|---|---|---|---|
| Re. 31,710 | 10/1984 | Jackson . | |
| Re. 32,690 | 6/1988 | Wong | 270/54 |
| 3,169,762 | 2/1965 | Parks . | |
| 3,229,599 | 1/1966 | Lowe . | |
| 3,484,100 | 12/1969 | Sather et al. . | |
| 3,519,264 | 7/1970 | Beacham et al. . | |
| 3,527,455 | 9/1970 | Reist . | |
| 3,536,550 | 10/1970 | Von Hofe . | |
| 3,554,531 | 1/1971 | Heigl et al. . | |
| 3,608,888 | 9/1971 | McCain et al. . | |
| 3,661,379 | 5/1972 | Dolfini . | |
| 3,664,655 | 5/1972 | McCain et al. . | |
| 3,689,693 | 9/1972 | Cahill et al. . | |
| 3,692,301 | 9/1972 | Wetter . | |
| 3,804,005 | 4/1974 | Burger et al. . | |
| 3,813,093 | 5/1974 | Taupin . | |
| 3,819,173 | 6/1974 | Anderson et al. . | |
| 3,892,427 | 7/1975 | Kraynak et al. . | |
| 3,899,165 | 8/1975 | Abram et al. . | |
| 3,902,708 | 9/1975 | Wise et al. . | |
| 3,917,252 | 11/1975 | Harder et al. . | |
| 3,924,845 | 12/1975 | Wise et al. . | |
| 3,953,017 | 4/1976 | Wise . | |
| 3,966,185 | 6/1976 | McCain et al. . | |
| 3,982,744 | 9/1976 | Kraynak et al. . | |
| 4,033,807 | 7/1977 | Neill et al. . | |
| 4,106,061 | 8/1978 | Burnett . | |
| 4,112,469 | 9/1978 | Paranjpe et al. . | |
| 4,121,818 | 6/1988 | Riley et al. . | |
| 4,121,818 | 10/1978 | Riley et al. . | |
| 4,133,521 | 1/1979 | Muller . | |
| 4,149,711 | 4/1979 | Jackson . | |

(List continued on next page.)

OTHER PUBLICATIONS

O.G. Notice for U.S. Pat. No. 4,753,439 to Irvine et al.
O.G. Notice for Reissue Pat. No. 32,690 to Wong.
Abstract of U.S. Pat. No. 4,259,696 to Paranjpe et al.

*Primary Examiner*—Paul A. Bell
*Attorney, Agent, or Firm*—Kilpatrick & Cody

[57] ABSTRACT

Selective collating and binding processes for manufacture of digest-size mail order catalogs, magazines or other materials. Such "books" are most economically collated and bound in pairs on a "2-up" line that simultaneously produces two output streams of books. Mail order retailers and others require that the books be organized according to postal zones for favorable mail rate treatment. They also frequently prefer that various sets of customers receive various editions of the book; repeat buyers, for instance, may receive a more complete edition of a catalog than other buyers. Similarly, two or more mailers may desire that their mailing be combined, so that two or more sets of catalogs are packaged together for the same postal zones in order to receive favorable mail rate treatment. Processes of the present invention provide selective binding and collating on a 2-up line of such different catalogs, different editions of the same catalog, or different editions of different catalogs, or "versions." Processes of the present invention sort address records according to postal zone and version, pair records for books whose versions match and control the collating and binding process utilizing the paired records. The collated and bound books may be organized and packaged in one output stream with use of a custom crossover mechanism, or in two output streams.

15 Claims, 10 Drawing Sheets

U.S. PATENT DOCUMENTS 4,168,828 9/1979 McLear et al. .
4,171,127 10/1979 Kish et al. .
4,174,829 11/1979 McCain et al. .
4,179,107 12/1979 Harris .
4,179,110 12/1979 Kosugi et al. .
4,225,872 9/1980 Marinoff .
4,241,908 12/1980 Marcus .
4,245,225 1/1981 Fillmore et al. .
4,259,696 3/1981 Paranjpe et al. ..... 358/296
4,384,196 5/1983 McCumber et al. .
4,395,031 7/1983 Gruber et al. .
4,493,482 1/1985 Valenti et al. .
4,544,146 10/1985 Zemke et al. .
4,582,312 4/1986 Abrams et al. .
4,585,220 4/1986 Zemke et al. .
4,753,429 6/1988 Irvine et al. ..... 270/58

TO:

PACKAGE ANALYSIS REPORT MAF-516

FOR: TESTING AGAIN

RUN NUMBER - 00 0002
JOB VERSION - 000100001
LIST VERSION - TEST IC 99

PALLET NUMBER: 0026

| NEW PKG. NUMB. | ORIG. PKG. NUMB. | TOTAL BOOKS | INPUT VERSION COUNTS, ACTIONS & ATTRIBUTES | | | | | | | | | | PKG. ACTIONS | | | |
|---|---|---|---|---|---|---|---|---|---|---|---|---|---|---|---|---|
| | | | V-01 | V-02 | V-03 | V-04 | V-05 | V-06 | V-07 | V-08 | V-09 | V-10 | SUB | BLK | SPR | HKS |
| 3931 | 3954 | 16 | 10 | | 6 | | | | | | | | | PP | | |
| 3932 | 3963 | 10 | 4 | | 6 | | | | | | | | | PP | | |
| 3933 | 3977 | 12 | 6 | 2 | 4 | | | | | | | | | PP | | |
| 3934 | 3982 | 20 | 10 | 4 | 6 | | | | | | | | | PP | | |
| 3935 | 3990 | 12 | 8 | | 4 | | | | | | | | | PP | | |
| 3936 | 4009 | 10 | 2 | 2 | 6 | | | | | | | | | PP | | |
| 3937 | 4019 | 10 | 6 | | 4 | | | | | | | | | PP | | |
| 3938 | 4022 | 10 | 40 | | 6 | | | | | | | | | PP | | |
| 3939 | 4033 | 12 | 6 | 2 | 4 | | | | | | | | | PP | | |
| 3940 | 4041 | 20 | 10 | 2 | 8 | | | | | | | | | PP | | |
| 3941 | 4049 | 14 | 6 | 4 | 4 | | | | | | | | | PP | | |
| 3942 | 4051 | 10 | 8 | | 2 | | | | | | | | | PP | | |
| 3943 | 4052 | 10 | 4 | 2 | 4 | | | | | | | | | PP | | |
| 3944 | 4054 | 10 | 4 | | 6 | | | | | | | | | PP | | |
| 3945 | 4072 | 10 | 2 | | 8 | | | | | | | | | PP | | |
| 3946 | 4090 | 12 | 4 | 2 | 6 | | | | | | | | | PP | | |
| 3947 | 4091 | 10 | 2 | 2 | 6 | | | | | | | | | PP | | |
| 3948 | 4095 | 14 | 4 | 2 | 8 | | | | | | | | | PP | | |
| 3949 | 4096 | 12 | 6 | | 6 | | | | | | | | | PP | | |
| 3950 | 4101 | 10 | 4 | 2 | 4 | | | | | | | | | PP | | |
| 3951 | 4102 | 10 | 6 | 2 | 2 | | | | | | | | | PP | | |

*MATCH LINE TO FIG 6B*

FIG 6A

MATCH LINE TO FIG 6A

| | | | | | | |
|---|---|---|---|---|---|---|
| 3952 | 4106 | 14 | 4 | 4 | 6 | PP |
| 3953 | 4107 | 10 | 6 | | 4 | PP |
| 3954 | 4112 | 20 | 10 | 6 | 4 | PP |
| 3955 | 4132 | 12 | 4 | 2 | 6 | PP |
| 3956 | 4138 | 12 | 4 | 2 | 6 | PP |
| 3957 | 4139 | 22 | 12 | 4 | 6 | PP |
| 3958 | 4144 | 14 | 8 | 2 | 4 | PP |
| 3959 | 4146 | 10 | 6 | | 4 | PP |
| 3960 | 4150 | 18 | 12 | 2 | 4 | PP |
| 3961 | 4180 | 12 | 4 | | 8 | PP |
| 3962 | 4185 | 10 | 2 | 2 | 6 | PP |
| 3963 | 4189 | 10 | 4 | 2 | 4 | PP |
| 3964 | 4204 | 16 | 8 | 4 | 4 | PP |
| 3965 | 4205 | 10 | 4 | 2 | 4 | PP |
| 3966 | 4215 | 18 | 6 | 4 | 8 | PP |
| 3967 | 4216 | 14 | 4 | 2 | 8 | PP |
| 3968 | 4217 | 14 | 4 | 2 | 8 | PP |
| 3969 | 4225 | 12 | 6 | 2 | 4 | PP |
| 3970 | 4226 | 10 | 4 | 2 | 4 | PP |
| 3971 | 4227 | 18 | 6 | | 12 | PP |
| 3972 | 4235 | 14 | 10 | | 4 | PP |
| 3973 | 4239 | 10 | 4 | 2 | 4 | PP |
| 3974 | 4242 | 10 | 8 | | 2 | PP |
| 3975 | 4243 | 10 | 6 | 2 | 2 | PP |
| 3976 | 4246 | 12 | 6 | 2 | 4 | PP |
| 3977 | 4262 | 28 | 16 | 2 | 10 | PP |
| 3978 | 4264 | 14 | 6 | 2 | 6 | PP |
| 3979 | 4275 | 22 | 4 | 4 | 14 | PP |
| 3980 | 4277 | 12 | 4 | | 8 | PP |
| 3981 | 4286 | 28 | 8 | 4 | 16 | PP |

MATCH LINE TO FIG 6C

FIG 6B

MATCH LINE TO FIG 6B

| | | | | | | | | |
|---|---|---|---|---|---|---|---|---|
| 3982 | 4293 | 10 | | 6 | 4 | | PP | |
| 3983 | 4300 | 36 | 10 | 6 | 20 | | PP | |
| 3984 | 4313 | 12 | 4 | 2 | 6 | | PP | |
| 3985 | 4329 | 26 | 10 | 2 | 14 | | PP | |
| 3986 | 4331 | 52 | 20 | 8 | 24 | | PP | |
| | | | | | | START OF STRING.... | | |
| 3987 | 3939 | 13 | 4 | 4 | 5T | | 1 | |
| 3988 | 3940 | 11 | 5T | 1S | 5L | | 3 | 1 |
| 3989 | 3944 | 17 | 7L | 4 | 6 | | 1 | |
| | | | | | | START OF STRING.... | | |
| 3990 | 3945 | 17 | 10 | 2 | 5T | | 1 | |
| 3991 | 3946 | 16 | 11T | | 5L | | 2 | |
| 3992 | 3947 | 26 | 17L | | 9T | | 2 | |
| 3993 | 3949 | 12 | 11T | | 1L | | 2 | |
| 3994 | 3951 | 22 | 9L | 3T | 10 | | 2 | |
| 3995 | 3952 | 16 | 10 | 1L | 5T | | 2 | |
| 3996 | 3955 | 17 | 7S | 1T | 9L | | 3 | 1 |
| 3997 | 3956 | 12 | 3T | 1L | 8 | | 2 | |
| 3998 | 3957 | 13 | 7L | 1T | 5S | | 3 | 1 |
| 3999 | 3958 | 18 | 7T | 3L | 8 | | 2 | |
| 4000 | 3959 | 12 | 5L | | 7T | | 2 | |
| 4001 | 3960 | 16 | 5T | 2 | 9L | | 2 | |
| 4002 | 3961 | 11 | 7L | 2 | 2 | | 1 | |
| | | | | | | START OF STRING.... | | |
| 4003 | 3964 | 11 | 4 | 1T | 6 | | 1 | |
| 4004 | 3967 | 11 | 6 | 1L | 4 | | 1 | |
| | | | | | | START OF STRING.... | | |
| 4005 | 3970 | 21 | 10 | | 11T | | 1 | |
| 4006 | 3971 | 12 | 2 | 1T | 9L | | 2 | |
| 4007 | 3972 | 11 | 2 | 1L | 8 | | 1 | |

MATCH LINE TO FIG 6D

FIG 6C

MATCH LINE TO FIG 6C

| | | | | | | | | | | | | | | | | | |
|---|---|---|---|---|---|---|---|---|---|---|---|---|---|---|---|---|---|
| | | | | | | | | | | | | | | | | START OF STRING | |
| 4008 | 3975 | 11 | 3T | 2 | 6 | | | | | | | | | | 1 | | |
| 4322 | 3938 | 12 | 9L | 1T | 2 | | | | | | | | | | 2 | | |
| 4323 | 4097 | 10 | 7T | 1L | 2 | | | | | | | | | | 2 | | |
| 4324 | 4111 | 11 | 3L | 2 | 6 | | | | | | | | | | 1 | | |
| | | | | | | | | | | | | | | | | START OF STRING | |
| 4325 | 4113 | 15 | 11T | | 4 | | | | | | | | | | 1 | | |
| 4326 | 4116 | 33 | 15L | 4 | 14 | | | | | | | | | | 1 | | |
| | | | | | | | | | | | | | | | | START OF STRING | |
| 4327 | 4122 | 25 | 14 | 3T | 8 | | | | | | | | | | 1 | | |
| 4328 | 4133 | 10 | 3T | 1L | 6 | | | | | | | | | | 2 | | |
| 4329 | 4182 | 10 | 5L | 1T | 4 | | | | | | | | | | 2 | | |
| 4330 | 4183 | 16 | 9T | 1L | 6 | | | | | | | | | | 2 | | |
| 4331 | 4045 | 18 | 7L | 2 | 9T | | | | | | | | | | 2 | | |
| 4332 | 4046 | 20 | 7T | | 13L | | | | | | | | | | 2 | | |
| 4333 | 4055 | 11 | 1L | 2 | 8 | | | | | | | | | | 1 | | |
| | | | | | | | | | | | | | | | | START OF STRING | |
| 4334 | 4061 | 11 | 7S | | 4 | | | | | | | | | | 1 | | 1 |
| | | | | | | | | | | | | | | | | START OF STRING | |
| 4335 | 4098 | 23 | 14 | 5T | 4 | | | | | | | | | | 1 | | |
| 4336 | 4303 | 50 | 28 | 5L | 17S | | | | | | | | | | 1 | | |
| | | | | | | | | | | | | | | | | START OF STRING | |
| 4337 | 4104 | 11 | 6 | 1S | 4 | | | | | | | | | | 1 | | 1 |
| TOTALS... | | 7209 | 3073 | 918 | 3218 | | | | | | | | | | | | |
| SPACER INSERT: | | 51 | 11 | 22 | 18 | | | | | | | | | | | | |
| BULK INSERT: | | 0 | | | | | | | | | | | | | | | |
| "SUBS" INTO: | | 0 | | | | | | | | | | | | | | | |
| "SUBS" FROM: | | 0 | | | | | | | | | | | | | | | |
| NET TOTALS... | | 7260 | 3084 | 940 | 3236 | | | | | | | | | | | | |

FIG 6D

BINDING AND COLLATING TECHNIQUES

This is a continuation-in-part of U.S. patent application No. 220,782 filed July 15, 1988 now abandoned also entitled "Binding and Collating Techniques," which is incorporated herein by this reference.

This invention relates to apparatus and processes for selectively collating and binding printed matter such as mail order catalogs and magazines. Such materials are referred to in this document as "books."

BACKGROUND OF THE INVENTION

Conventional collating and binding apparatus utilizes printed sheets which arrive from a press folded into 8-, 16-, 32- or 64-page sections known as "signatures." Signature dispensers known as "pockets" store stacks of signatures. The pockets drop the signatures onto a conveyor chain which travels past a line of pockets; the signatures hang from the chain as do blankets on a clothesline. The apparatus builds a book as a station on the chain corresponding to the book travels past a succession of pockets and receives a succession of signatures dropped on one another by the pockets. The chain continues past a stapler or stitcher which staples, stitches or otherwise fastens the signatures together. An infeed/reject station pulls the books off of the chain and forwards them via a belt conveyor to a trimmer where three separate knives trim the top, bottom and non-stapled edges. The trimmer typically sends the books to a stacker which organizes the books into stacks or "packages." The stacker sends the packages to one or more strapping machines which place straps around the packages. The packages may then be sent to a mail table or other processing station. A programmable device typically controls the timing and operation of the pockets, stapler, infeed/reject station and stacker.

Mail order catalog and magazine manufacturers typically classify books into two sizes: a "chopper" size and a "digest" size. Chopper size books are typically on the order of eight inches by eleven inches, while digest books are usually approximately five inches by eight inches. Long ago the industry recognized that digest books can be manufactured more efficiently by collating, binding and processing digest-size books simultaneously in pairs. The pockets and conveyor chain operate as described above, but each signature contains two book sections, a leading section and a trailing section. Each book taken from the conveyor chain at the infeed station thus actually forms two books, a leading book and a trailing book. A fourth and fifth knife cut in half each book received from the first, three-knife, trimmer and trim the trailing edge of the leading book and the leading edge of the trailing book. The trimmer sends the leading books to a first or "A" stacker with its associated "A" strappers and mailing table and the trailing books to a "B" stacker with its associated "B" strappers and mailing table. Twice as many digest-size books may thus be formed per increment of time using this double stream or "two-up" process. The "two-up" process is often referred to as a "five-knife" process because of the fourth and fifth knives which form two books from one. The process which forms one chopper book at a time is likewise referred to as "one-up" or "three-knife" process.

Collating and binding lines typically utilize analog or digital techniques and computing circuits to track books as they are formed on the chain and travel through the trimmers and stackers. A timing transducer such as a magnetic transducer adjacent to the conveyor chain typically senses a mark associated with chain position, such as on a drive shaft, and sends a synchronization pulse to the computer so that the computer is synchronized with chain movement. The computer in turn delivers signals to the pockets to instruct them when to drop signatures onto the chain. The computer typically contains shift registers through which a code corresponding to each book progresses as the book travels down the chain and through the infeed, trimmer and stackers. The computer thus "knows" where each book is and which components of the line are operating on which books at a particular time. In this way, for instance, a book is tracked starting at the first pocket, and the computer may, while the book is being formed, simultaneously be controlling the printing of a mailing label that will be glued to the book when it reaches a label station after trimming.

The computer may also receive a thickness signal for each book from a caliper adjacent to the conveyor chain and compare that signal, which corresponds to the actual thickness of the book, to a preset or predetermined thickness value. If the actual thickness falls outside of a predetermined tolerance, the computer can deliver a signal to the infeed station causing it to reject or discard the book. The computer can then reorder the book by, for instance, reinserting the book's version code into the shift registers so that the pockets receive signals to form the book once again. The pockets themselves may also send error signals so that books can be rejected and reordered when a pocket fails to drop a signature.

Collating lines also frequently incorporate ink jet printers adjacent to the conveyor chain for printing information on the books. A first ink jet may, for instance, be located adjacent to the chain after the first two pockets. It may be located under the chain to spray ink o the interiors of books as they travel by in order to form name and address information on order forms or other interior pages. A second ink jet may also be located after the last pocket adjacent to the conveyor chain to print mailing information on the outside cover. Such ink jets are typically controlled by a computer that communicates with the collating line computer or forms a portion of it. Collating and binding lines which include reject and reorder mechanisms that track books through the line and that include such ink jets can thus reorder, remanufacture and reprint information on books that were earlier rejected for improper thickness or because a pocket failed to drop a signature.

Conventional collating lines may also manufacture books in a sequence organized by carrier route, zip code, sectional carrier facility, bulk mail facility or other "zone" for efficient mail handling and favorable postage rate treatment. The computers in such lines typically receive tape recorded digital formatted information in which records for the books are presorted into the desired zone format. The computer tracks the books serially through the line and onto the stackers and strappers. The stackers and strappers separate the books into zone packages and send the packages to the mail table for stacking on pallets or in mail bags.

Retailers and other mailers sometimes desire that different editions of the same catalog be sent to different categories or sets of recipients. Such retailers have segmented their markets and identified a first set of addressees as appropriate for a first edition of book, a second set for a second edition and perhaps more sets for more editions. The different editions of the same catalog may include different numbers of signatures, for instance, or certain of the signatures may be substituted for others. A typical example of books made according to such "selective binding" techniques are different versions of the same national weekly news magazine which include several pages targeted to a particular city, state or other local audience. Similarly, a mail order retailer may desire that addressees who have never purchased from the retailer receive a thinner edition of a catalog while repeat buyers receive catalogs that show more or different types of merchandise.

Additionally, a mailer's list of addressees may fail to include a sufficient number of addressees in many carrier routes (or other postal zones) to allow the mailer to maximize favorable postal rate treatment by mailing books packaged according to carrier route. However, if other similar mailers with similar lists exist, then two or more of the lists could be combined in order to sort address records for, and simultaneously manufacture, package and mail, two or more different catalogs (or various editions of the two or more catalogs) so that the mailers maximize favorable postal rate treatment.

One-up selective binding processes utilizing address records sorted by zones to produce zone packages containing several editions of the same of book are conventional. One-up processes selective binding processes could also be used simultaneously to manufacture and mail different catalogs or editions of different catalogs. The term "version" as used in this document refers to different editions of the same catalog, different catalogs, different editions of different catalogs, or other sets of books, each of which sets contains a combination of signatures different from the other sets.

In a one-up selective binding process, the books are serially manufactured, zone by zone, on the conveyor chain as various combinations of pockets drop the required signatures onto the chain corresponding to the required version of each book. The computer tracks the books as they serially progress through the trimmer and to the stackers and strappers. It controls the stackers and strappers to organize and package the books into packages according to zones.

A two-up collating and binding line does not produce books serially, however; it simultaneously manufacturers pairs of books to produce two output streams of books. Leading books of the pairs flow to a first stacker, strappers and mail table to produce a first set of packages while trailing books of the pairs simultaneously flow to a separate stacker, strappers and mail table to produce a second set of packages. The leading book frequently bears an address for an entirely different state than the trailing book.

The likelihood that each zone package to be produced on the "A" side (from leading books) will contain the same number of books as the corresponding zone package produced simultaneously on the "B" side (from trailing books) is minimal, much less the chance that each package will contain the same number of each version of book so that each leading and trailing book can be matched in pairs and formed simultaneously on the conveyor chain.

The conventional solution is thus to selectively bind digest-sized books in a one-up rather than a two-up process.

SUMMARY OF THE INVENTION

The present invention provides apparatus and methods for selectively manufacturing and binding books in a two-up process. According to a first, "1-out," aspect of the invention, computer programs sort address records by carrier route, zip code, sectional carrier facility or other zone to match pairs of addressees in the zones who will receive identical book versions. The leading and trailing books of a book produced on the conveyor chain thus go to two addressees in a single zone who will receive the same version of the book. When a zone contains an odd number of address records for a particular version, computer programs according to the invention place the unpaired versions at the beginning or end of the records for the zone. The programs then search for other zones having a matching unpaired address record for that version and "string" the zones together. A book on the collating chain for two such "odd" versions thus actually comprises that last book for one zone package and the first book for the next zone package. Each trailing book is physically lifted from the "B" processing line after trimming and placed on the "A" line behind its corresponding leading book as the leading books progress down the "A" processing line after trimming. The books are then serially stacked into packages corresponding to zone and strapped and mailed. The leading books may just as easily be lifted and interposed between trailing books.

According to a second, "2-out," aspect of the present invention, the leading books are stacked, strapped and mailed on the "A" processing equipment independently of the trailing books which are processed on the "B" processing equipment. The only feature that a particular leading book and its corresponding trailing book have in common is that they are the same version; they may be addressed to recipients in two entirely different states. Indeed, the leading books may be an entirely different mail order catalog or other document from a different retailer than the trailing books simultaneously being manufactured, packaged and mailed.

It is therefore an object of the invention to provide 2-out selective collating and binding processes.

It is an additional object of the invention to provide 2-out selective collating and binding processes which can sort records for and simultaneously manufacture different editions of a catalog, different catalogs, different editions of different catalogs or other sets of books, each of which sets contains a different combination of signatures.

It is an additional object of the invention to provide 2-out selective collating and binding processes in which one output stream is merged into the other output stream.

It is an additional object of the invention to provide 2-out selective collating and binding processes in which both output streams simultaneously produce books for processing and mailing.

It is an additional object of the invention to provide 2-out selective collating and binding processes which maximize favorable postal rate treatment for the books produced.

Other objects, features and advantages of the invention will become apparent with reference to the remainder of this document.

BRIEF DESCRIPTION OF THE DRAWINGS

FIG. 6 is a package analysis report generated by the 1-out process of FIG. 5.

DETAILED DESCRIPTION OF THE INVENTION

Figure 1:
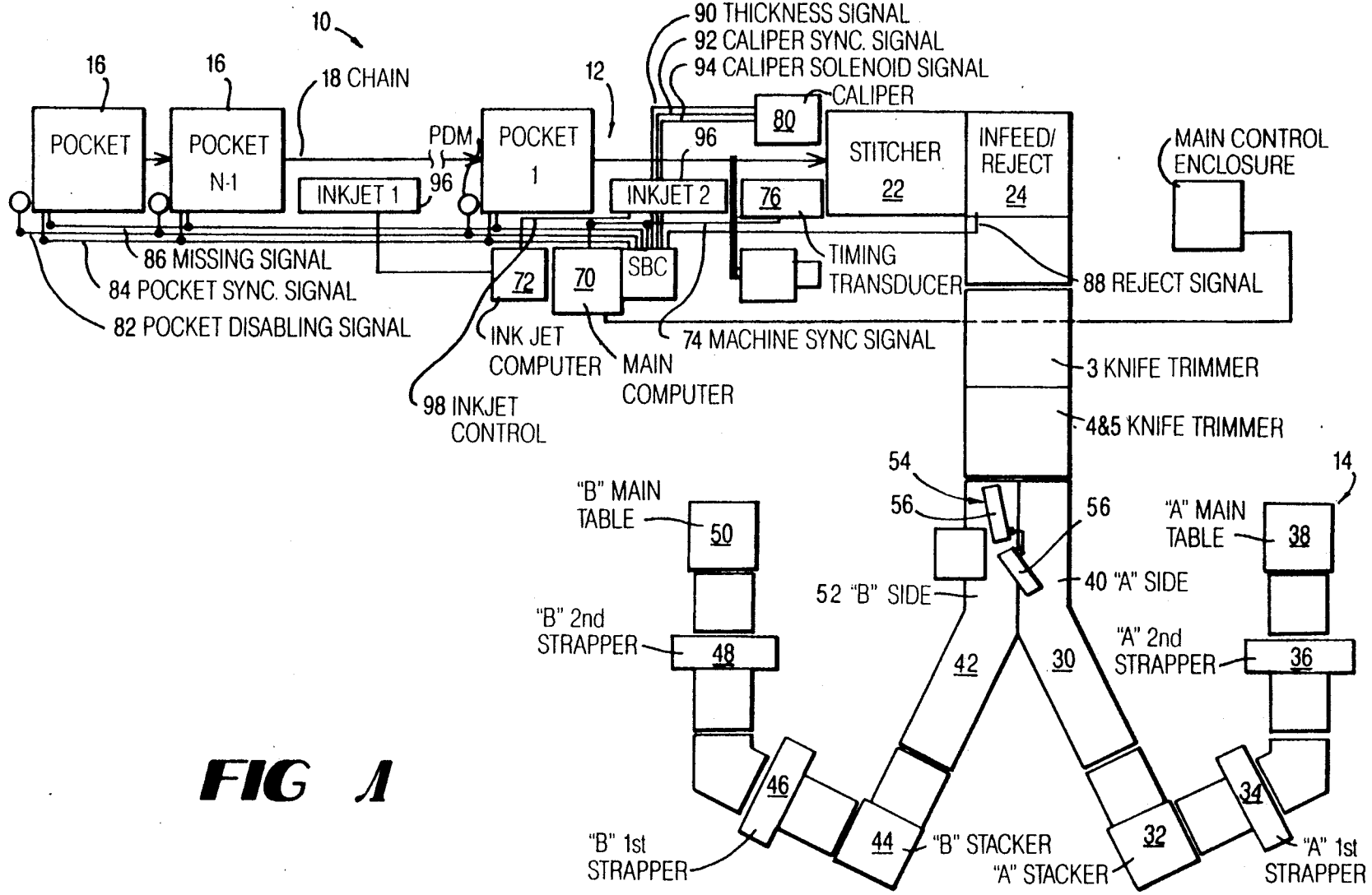
FIG. 1 is a schematic illustration of a collating and binding line which may be used according to the present invention.

FIG. 1 schematically shows a collating and binding line 10 which may be used according to the present invention. Line 10 comprises generally a collating section 12 and a processing section 14. Pre-printed, prefolded and pre-cut signatures of 8, 16, 32 or 64 pages are stacked into pockets 16. A conveyor chain 18 travels past the pockets 16. The pockets 16 drop signatures onto the chain 18 as it travels past, on receipt of signals from a selective binding computer 20 which controls the operation of line 10. For instance, pocket n shown in FIG. 1 may drop a first signature onto which pocket n−1 drops a next signature and so fort until pocket 1 drops the last and outer signature to form a book. Chain 18 continues past a stapler or stitcher 22 which places staples or stitches in the back of books. Chain 18 then carries the books into an infeed/reject station 24 which rejects books that are improperly formed and which extracts acceptable books from the chain 18 and sends them to a three-knife trimmer 26. Three-knife trimmer 26 trims the upper, lower and non-stitched side edges of books and then sends them to an additional trimmer 28. Trimmer 28 contains a fourth and fifth knife for cutting the books in half to form a leading book and a trailing book.

The leading books are transported via a first set of conveyors 30 to stacking equipment 32, strappers 34 and 36 and mail table 38. These form the "A" side 40 of line 10. The trailing edge books are transported via a second set of conveyors 42 to stacking equipment 44, strappers 46 and 48 and mail table 50 that form the "B" side 52. The stackers 32 and 44 separate books according to carrier route, zip code or other zone on command from computer 20 and stack them into packages. Strappers 34, 36, 46 and 48 place bands around the packages of books formed by the stackers. The strapped packages arrive at mail tables 38 and 50 where operators place them on pallets or in mail sacks for shipment.

Figure 4:
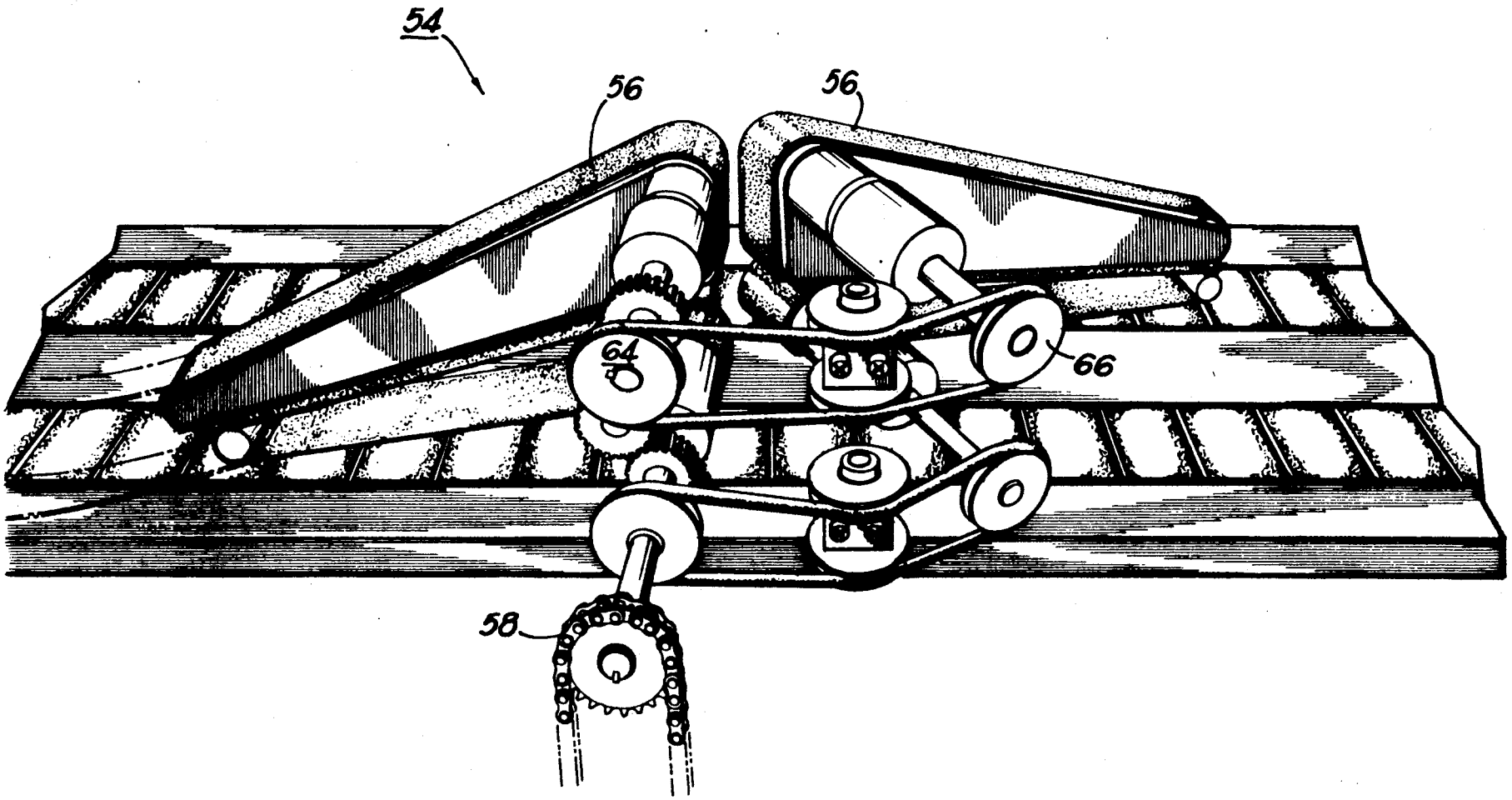
FIG. 4 is a perspective view of a crossover mechanism of the binding line of FIG. 1.

Crossover mechanism 54 may be placed on line 10 to retrieve books from "B" side 52 and interpose them between corresponding books on "A" side 40 to form one stream of books from two. Crossover mechanism 54 as shown in FIG. 4 may be a pair of conveyor belts that lift books from "B" side conveyors 42 and place them onto "A" side conveyors 30. The conveyor belts 56 of crossover mechanism 54 may receive power from chains or belts connected to the means that actuate conveyors 30 and 42. In a preferred embodiment of the invention, conveyor mechanism 54 contains a sprocket 58 which is driven by a chain from a sprocket connected to drive shafts for conveyors 30 and 42. Sprocket 58 is geared to conveyor pulleys 64 and 66 which in turn are mounted on shafts that support and drive conveyor belts 56. Conveyor pulleys 64 and 66 for multiple conveyor belts 56 may be connected by belts as shown in FIG. 4. Sprocket 58 and conveyor pulleys 64 and 66 are sized to allow conveyor belts 56 to be synchronized with conveyors 30 and 42.

Crossover mechanism 54 is useful to convert the side-by-side book output from the trimmers 26 and 28 into a single stream in order to serialize the output of the binding and collating line and make simpler the task of organizing books into packages for each postal zone. The side 40 or 52 of the processing section 14 which handles the single stream of output must thus run twice as fast as it would when both sides 40 and 52 are handling the output from the collating section 12. Crossover mechanism 54 is used in the 1-out processes of the present invention, but it is not used for 2-out processes, where both the "A" and "B" sides of the line 10 operate.

Line 10 is controlled by selective binding computer 20 which communicates with a main computer 70 and an ink jet computer 72. Selective binding computer 20 contains two shift register tables, a version code table and a pocket on/off data table. The operator before a production run enters definition information for each desired version of book into a setup data table, including which signatures the book version contains and the book's thickness. As the line 10 operates, main computer 70 receives a succession of machine-synchronization ("sync") signals 74 from a magnetic timing transducer 76 connected in a conventional manner to collating section 12. These signals synchronize main computer 70 to conveyor chain 18 and collating section 12. Main computer 70 in turn provides the machine-sync signals 74 to selective binding computer 20 via a selective binding controller communication link.

Main computer 70 reads book address records from a conventional input/output means such as a magnetic tape. Main computer 70 extracts a binary version code from each successive address record on the tape and places that version code 78 on the trailing edge of successive machine-sync signals 74 provided to selective binding computer 20.

The version code table and the corresponding pocket on-off data table of selective binding computer 20 each contain a number of registers which correspond to successive pockets 16 on line 10, a thickness caliper 80 located on the line after the pockets 16, the infeed/-reject station 24 and other components of the line as desired. Each version code as received by selective binding computer 20 from main computer 70 is placed in the bottom register of the version code table and advanced one register as each machine-sync signal 74 is received. The version code in the bottom register is utilized to access the setup data table for acquisition of the appropriate pocket on/off data for the book. This pocket on/off data is placed in the bottom register of the pocket on/off data table and advanced simultaneously with its corresponding version code.

As a particular station on conveyor chain 18 progresses down line 10 toward the first pocket 16, selective binding computer 20 receives the corresponding version code for the book to be built on that station from main computer 70. It places the version code and its corresponding pocket on/off data in the version code and pocket on/off tables. As the station reaches the first pocket 16, selective binding computer 20 receives another machine-sync signal 74 and advances the version code and the pocket on/off data into the registers in the version code and pocket on/off tables that correspond to the first pocket 16. Selective binding computer 20 transmits a pocket disabling signal 82 to the first pocket 16 depending upon the values held in the first pocket 16 register in the pocket on/off table. A low value indicates that the pocket should be deactivated in order to refrain from dropping a signature onto chain 18, while a high value indicates that a signature should be dropped.

Each pocket 16 also produces, via a cam-follower, magnetic transducer or other appropriate means, a pocket-sync signal 84 which further synchronizes the pockets 16 to collating chain 18. If a particular pocket 16 fails to drop a signature when instructed to do so by selective binding computer 20, the pocket 16 generates and sends to selective binding computer 20 a missing signal 86. That signal 86 is stored in computer 70 and utilized to actuate infeed/reject station 24 via a reject signal 88 as the appropriate book reaches the infeed/-reject station 24.

Selective binding computer 20 receives another machine-sync signal 74 as the book being discussed reaches the second pocket 16. That book's version code and pocket on/off data advance another register in their respective tables. The selective binding computer transmits a pocket disabling signal 82 corresponding to the value of the data in that pocket's registers and the process continues.

The book progresses down the line until it reaches thickness caliper 80 adjacent to chain 18. Caliper 80 may be a spring-loaded cam or roller which bears against books on chain 18 and generates an analog thickness signal 90 corresponding to the displacement of the cam. The thickness signal 90 is converted into digital format and transmitted to selective binding computer 20. If the signal falls outside of tolerances set in by the operator before the run for the particular version of the book, selective binding computer 20 "reorders" the book by instructing main computer 70 to reprocess the address record for the book. Thickness caliper 80 measurement timing is controlled by a caliper-sync signal 92 from selective binding computer 20.

Selective binding computer 20 sends a caliper solenoid signal 94 to thickness caliper 80 if the thickness signal 90 for the book falls outside of preset limits. Solenoid signal 94 activates a solenoid in thickness caliper 80 which pushes pins into or out of holes on the periphery of a caliper delay wheel in caliper 80. The delay wheel rotates in synchronization with chain 18. Pins on the periphery of the delay wheel correspond to books o chain 18 and rotate in synchronization with chain 18 to an analog angular position corresponding to the stitcher 22 and then to a second angular position corresponding to the infeed/reject station 24. If a pin was pushed by the solenoid in thickness caliper 80, it actuates a stop stitch solenoid at the stitcher 2 position adjacent to the delay wheel in order to deactivate the stitcher 22. The pin similarly moves a reject gate solenoid adjacent to the delay wheel corresponding to the position of the infeed/reject station 24 in order to cause the book to be rejected. This delay wheel/pin/solenoid mechanism is conventional in binding lines; it may easily be transformed into a digital process in which selective binding computer 20 directly controls stitcher 2 and infeed/-reject station 24.

Contemporaneous with movement of chain 18 and data in the selective binding computer version code table and pocket on/off tables, main computer 70 feeds information to ink jet computer 72 to control ink jet printers 96. The first ink jet printer 96 may be, for instance, located after the second pocket and a second ink jet printer 96 may be located after the last pocket to print information inside a book and on its cover, respectively. In one conventional application, the first ink jet printer 96 prints customized address information on an order envelope contained in a mail order catalog and the second ink jet printer prints the address information for mailing on the back cover. Ink jet printers 96 are conventional for this purpose; the heads for such printers are stationary while relative movement is provided by chain 18. Ink jet printers 96 are controlled by ink jet control signals 98 from ink jet computer 72. Where the line 10 is producing digest books, ink jet printers 96 must print two sets of addresses and interior information for each book built on chain 18.

Where line 10 is producing digest books as contemplated according to the present invention, each book that is not rejected is extracted from the infeed/reject station 24 and sent via conveyors to a first three-knife trimmer 26 where its top, bottom and non-stitched edges are trimmed. The book then progresses to second trimmer 28 where it is cut in half and trimmed to form two separate digest books. Those books are then processed on both the "A" and "B" sides 40 and 52 according to the "2-out" process of the present invention, or on a single side according to the "1-out" process.

A. 1-out Processes

Programs which perform 1-out processes of the present invention read data from a magnetic tape containing address records corresponding to a pallet or a sack of mail. A "pallet" for purposes of the invention is a collection of packages for the same high level destination, such as a sectional carrier facility, that typically weighs between 600 and 1800 pounds. A "sack" is a collection of packages for the same high level destination but with a much smaller capacity, typically between 20 and 50 pounds. The program reorganizes the address records for each pallet or sack and outputs them to an output or resequence data file and ultimately a resequence data tape for use by main computer 70 to control manufacture of books on line 10. For convenience, address records are referred to sometimes hereinafter as "books;" sets of records corresponding to packages of books are referred to as "packages;" and sets of records corresponding to a pallet or sack are referred to as "pallets" or "sacks." Pallets or sacks are sometimes referred to as "makeups."

Although books of the same version are paired within packages, books are never removed from their package according to the 1-out processes. Packages may, however, be renumbered and displaced in sequence within a pallet or sack. When a package contains an odd number of books of a particular version, so that the remainder book cannot be paired with another book of the same version in the package, the book (or another in the package) may be "version-promoted" to another version for pairing. If version-promotion is deemed inappropriate, the remainder book may be paired with a "spacer" or "bulk" book. Spacers are books that may be discarded or specially utilized. Bulk books are books that contain special printed information and can be specially utilized. Examples of special utilization include distribution at the mailer's retail outlets or as stuffers in catalog orders. A third technique of dealing with an unpaired book in a package is to pair it with an unpaired book in another package and thus "string" the packages as described below.

Figure 2:
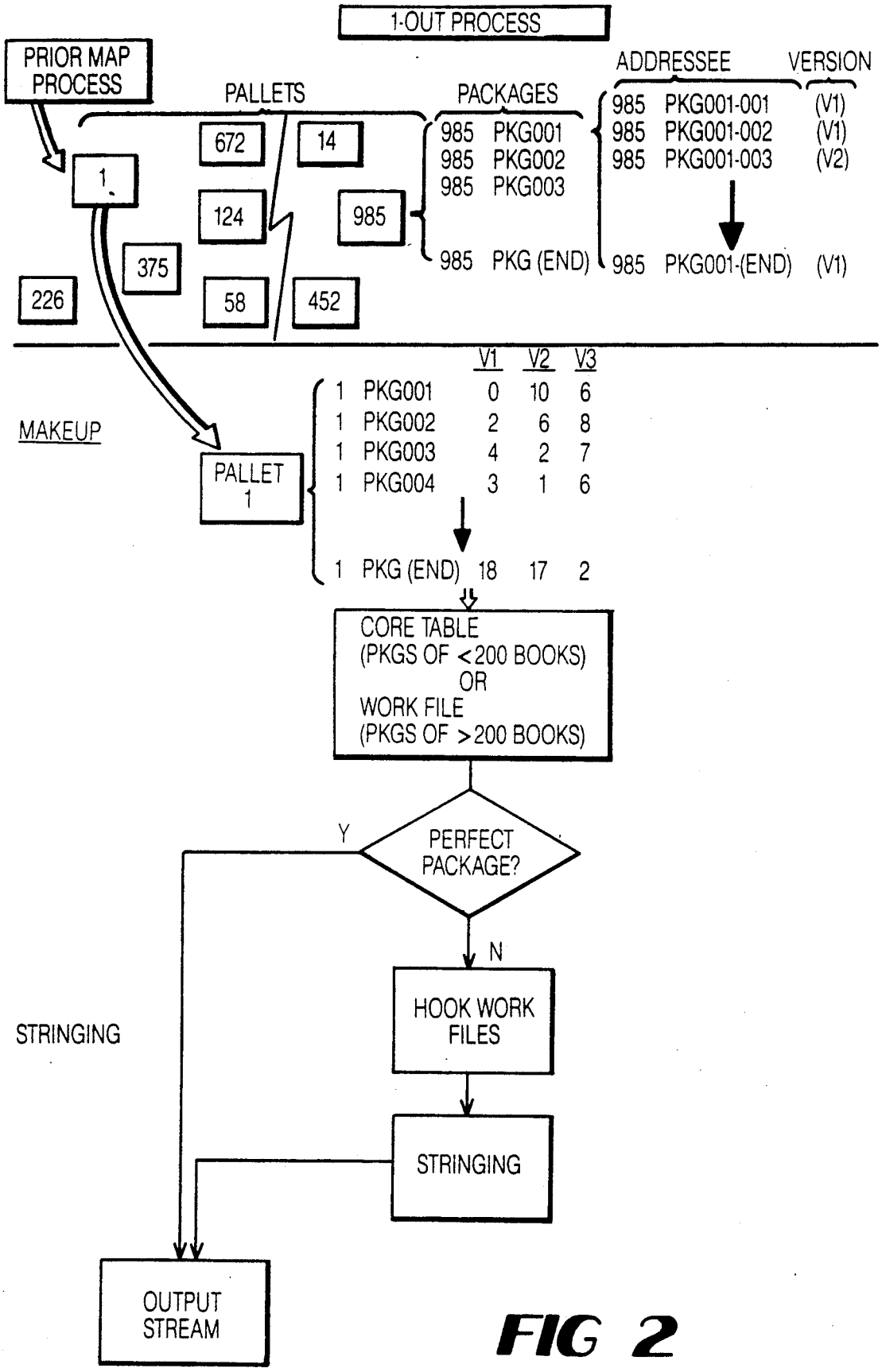
FIG. 2 is a schematic diagram showing steps of 1-out techniques and processes of the invention.

The 1-out process sorts books by a pallet or a sack ("makeup") at a time. As shown in FIG. 2, packages are written into a core table having a size of 200 books. If a package is larger than this limit, then a disk workfile is used to help process the books of the package. At the end of the package a determination is made as to whether the package contains any unpaired book versions. Packages containing no unpaired book versions ("perfect packages") ar written straight to the resequence data file from the core table (and possibly also the package workfile) with the books shuffled so that pairs of like version are together. If the package is not a perfect package, it contains at least one book which does not have a matching book of the same version code (a "hook"). A package containing one hook is a "single-hook package" and a package containing more than one hook is a "multi-hook package." Hook packages are written to the first of two hook workfiles together with additional information which identifies the packages and includes, for instance, number of hooks, which versions are hooks and number of books. Such packages are written to the workfile in the sequence (1) package header, (2) unpaired books and (3) pairs of books.

At the end of a makeup, a stringing process commences on those hook packages in the first hook workfile. A first, preferably single-hook package, is output to the resequence data file. The first hook workfile is read end to end, and for each package a decision is made as to whether the package can be appended to the previous package written to the resequence data file. If the package can be so appended, then the package is selected to be written to the resequence data file. The sequence of books in a package is:

(1) leading hook (if applicable);

(2) natural or version-promoted book pairs (if present);

(3) internal hooks with spacers or bulks (if present); and (4) trailing hook (if available and linkable).

Packages not appended to the resequence data file are written to the second hook workfile.

At the end of the pass on workfile 1 the roles of the two workfiles are reversed. Workfile 1 is reopened for output and workfile 2 is reopened for input. The packages from workfile 2 are read and either written to the resequence data file or to workfile 1. This "flip-flop" read-write process continues until all packages for the makeup have been written to the resequence data file. For an average pallet, five passes of the workfiles are required. Each pass typically results in 50–60% of the packages in a given workfile being written to the resequence data file. The average number of packages being read from a workfile in this process is about twice the number contained in the pallet (due to double or triple reads of some packages).

A string commences when a package with matched pairs at the beginning of the package and hooks (if any) at the end is written to the resequence file. The absence of a hook at the beginning of the package means that the package is not version-linked to a hook at the end of the previous package. The stringing process starts each string with a single-hook package whenever possible. This reduces the need for spacer books as the single hook can be trailed and linked with another hook in a following package. A string ends whenever (a) a single-hook package is appended to it (and thus no trailing hook is available to continue the string); or (b) no packages remain in the workfiles which can be linked to the last package written to the resequence data file.

When a string begins and ends with a single-hook package (the first package having a trailing hook and the last package having a leading hook), then a "perfect string" is considered to have been formed. No spacer books are required except those which must exist inside packages containing three or more hooks (only two hooks per package can be version-paired across the package boundary, one at the start and one at the end). Most strings created for a pallet according to the invention will be perfect strings. Those strings which must begin or end with a multi-hook package will require one or two spacer books. This condition exists more typically at the end of a makeup when there are only a few packages remaining, and suitable ones cannot be found to continue the string.

The maximum number of spacer books that can be required for a makeup to complete imperfect strings is equal to the number of book versions. A four-version system thus cannot require more than four spacers to complete imperfect strings in any one pallet or sack.

Stringing according to these processes is more efficient for makeups containing greater numbers of packages. Pallets are thus more spacer-book efficient than sacks. The processes favor the option of trailing a hook which permits continuation of the string rather than trailing a hook for which there is no complement in the workfile. This feature reduces the number of imperfect strings created by the process.

The passing of the workfiles is not a haphazard process. Summary core tables are maintained, which describe the remaining contents of the workfile. In this way, the workfiles need not be searched for a package type which they do not contain.

In production runs that require three or more versions of books, many packages will contain more than two hooks. Since only two hooks may be utilized to string packages together (one leading hook and one trailing hook) the hooks in excess of two are ordinarily paired with a spacer book. The version promotion feature of the present invention mitigates this problem.

Version promotion is the act of altering the version of one or more books in order to reduce the number of spacer or bulk books in a package. Without version promotion, a package containing three or more hooks would always require one or more spacer or bulk books.

The present invention includes three types of version promotion: (1) pre-stringing promotion or "pre-promotion;" (2) post-stringing promotion or "post-promotion;" and (3) external promotion. Pre-promotion and post-promotion change the version of hooks in packages to those of other hooks in the same packages. External promotion changes the version of hooks to the version of hooks in other packages.

Pre-promotion is carried out before any attempt is made to concatenate packages into strings. Pre-promotion operates only on packages which contain sufficient books to justify pre-promotion according to "rules" discussed below. Pre-promotion does not operate on packages that contain only one or two hooks, because such packages are well-suited for the stringing process.

Post-promotion, if selected, operates on packages after they have been appended to a package string and still contain surplus hooks (even after one or two are used as links in the stringing process). Pre-promotion and post-promotion are preferably mutually exclusive; pre-promotion usually promotes the hooks that would be promoted by post-promotion, so that use of both processes would usually be redundant. Pre-promotion is usually preferable to post-promotion, because it usually operates on more multi-hook packages than post-promotion does and thus saves spacers and bulk books. Post-promotion requires less computer time to run, however, and it, or a combination of pre-promotion and post-promotion, may be desirable in some applications.

In addition to pre-promotion or post-promotion to pair books within a package ("internal version promotion"), books may also be version promoted to produce a trailing hook according to an "external version promotion" operation. External version promotion takes place when a string cannot be continued by using the hooks available in the current package. Rather than end the string by pairing a spacer or bulk book with a hook, external promotion changes the unpairable hook so that it can match a hook in a package remaining in the workfile, in order to continue the string.

Version promotion programs of the present invention consult a "rule table" in order to determine how to handle the odd versions. The rules are applied (in a customer-specified priority) until all the odd books in the package have been handled. Any odd books still remaining to which no rule is applied and which have not been accommodated by stringing will take spacer or bulk books as a default. A format for a rule record is as follows:

| | Field | Format | Description |
|---|---|---|---|
| A | Rule # | xx | 01-20 |
| B | Rule Type | x | C = Change<br>B = Bulk |
| C | Version Code | xx | 01-10 |
| D | New Version Code | xx | 01-10 |
| E | Change Direction | x | S = Single Direction<br>B = Bidirectional |
| F | Change Benefit | x | 2 = Obey only if two spacers/bulks are prevented<br>1 = Obey even if only one spacer/bulk is prevented |

Fields D through F will be populated only on change-type rules. When present, change-type rules will precede bulk-type rules. Bulk rules are utilized to determine whether a spacer should be promoted to a bulk book. A bidirectional change direction tends to stabilize the total number of books of each version at the number of books for that version before version promotion occurred. If a single directional change is specified, for instance, version A to version B, more version B books may be produced than would originally have been produced. The rules may indicate that no version promotion is desired, such as, for instance, when the projected or anticipated number of spacers or bulk books is considered insignificant or tolerable.

Figure 5:
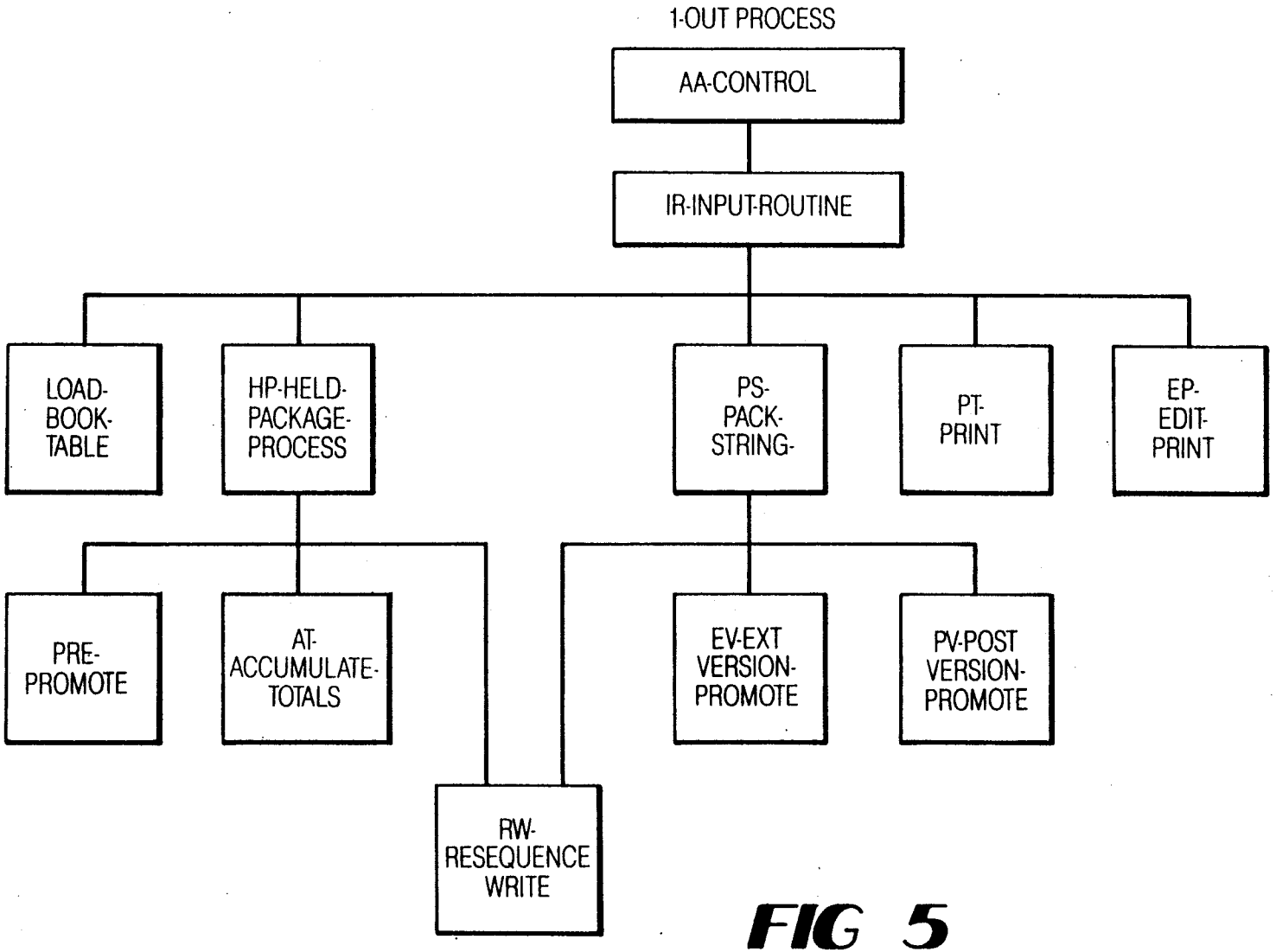
FIG. 5 is a block diagram of a preferred embodiment of 1-out processes of the invention.

The following description discloses steps performed by modules according to 1-out processes of the invention, with reference to FIG. 5, the 1-out system block diagram.

AA-CONTROL

-continued

This section has overall control of the program.

Operations (1) Read run parameters, version promotion rules, processing options
(2) Initialize working data fields
(3) Open and initialize files
(4) Perform the IR-INPUT ROUTINE
(5) Check for out-of-balance condition in program counts
(6) Finalize and close files
(7) Check for any abnormal file I/0
(8) Stop run

IR-INPUT-ROUTINE

Process address records of incoming pallets and sacks

Operations (1) Initialize dynamic working fields
(2) Read a single address record and check for read error
EOF: Go to (8)
(3) Perform EDIT-PRINT-IMAGE
(4) Check for sack diversion
Yes: Divert sacks for later process
(5) Check for package break
Yes: Perform HP-HELD PACKAGE-PROCESS
Check for makeup break
Yes: Perform PS-PACK-STRING
Perform PT-PRINT
Clear makeup table
(6) Perform LB-LOAD-BOOK-TABLE
(7) Go to (2)
(8) Were sacks diverted?
Yes: Read diverted sack file
EOF: Perform (3) to (6)
Go to (8)
(9) Perform HP-HELD-PACKAGE-PROCESS
(10) Perform PS-PACK-STRING
(11) Perform PT-PRINT

LB-LOAD-BOOK-TABLE

Operations

Add the current address record into the book table (100 pair maximum). If the table fills, matching pairs are written to a pack workfile - leaving unmatched book versions in the table for re-matching as more books are read.

HP-HELD-PACKAGE-PROCESS

Called when a complete package has been read. Determines the condition of each package - perfect or containing hooks (hooks being unpaired book versions).

Operations (1) Prepare header record for package analysis file and count unpaired address records in package
(2) If Pre-promotion?
Yes: More than 2-hook package?
Yes: Perform PP-PRE-PROMOTE
(3) No-hook package?
Yes: Write address record pairs to resequence data file using RW-RESEQUENCED WRITE
Perform AT-ACCUMULATE TOTALS
Write package analysis record
(4) 1 or more hook package?
Yes: Write header record to workfile 1
Write unpairable address records to workfile 1
Write paired address records to workfile 1

PS-PACK-STRING

Called when a complete sack or pallet has been read. Performs the "stringing" process of logically linking packages which have hooks of the same book version so -continued that the two hooks form one book pair.

Operations

Stringing takes place by placing an unpaired book version at the end of one package and then placing an unpaired book version of the same type in the next package at the beginning of that package to form the pair.

Packages are selected for output based on their ability to complete a pair.

Unpairable books in a package are given spacer books at this stage. The package sequence is determined by maintaining a program core table of information about all hook packages in the current sack or pallet and then by scanning the table to:

(a) know what packages remain available to the stringing process; and (b) determine which package should be used to continue the string most efficiently.

Since all hook packages for the pallet/sack are held in a workfile, the stringing process uses a "flip-flop" technique for handling the packages. As a package is read from workfile 1 (into a core table), a determination is made as to whether it is one of the packages known to be available which would satisfy the current hook linking requirement.

If it is, then the package is routed (in correct sequence) to the final output file.

If not, then the package is copied to workfile 2, and the next package from workfile 1 is checked.

At the end of workfile 1, some of its packages have been routed to final output file and the others to workfile 2. Both workfiles are now closed, and workfile 2 is re-opened for input while workfile 1 is opened for output (as an empty file). The selection process continues with packages from workfile 2 now being routed either to workfile 1 or to the final output file. This "flip-flop" of workfiles continues until all the hook packages have been routed to the final output - leaving none on either workfile.

Information about the stringing process is written to the package analyzer (cross reference) record.

PT-PRINT

This section produces the control report at the pallet/sack, split and grand total levels.

Operations

The totals are broken by book version and total, each of which is broken by original books, spacer books added, bulk books added, promoted in, promoted out and the net result. A lookup on zip code is performed to determine BMC code using external module MAP 625.

EDIT-PRINT-IMAGE SECTION

This section validates the incoming file to ensure that it is suitable for performing the required sortation.

Operations

This section is performed for every file read. It validates:

(a) Book version is numeric 01 through 10;

(b) Makeup type = "P" or "S" (Pallet or Sack);

(c) Package break indicator = "Y" or "N" (Yes or No);

(d) Makeup break indicator = "Y" or "N" (Yes or No);

(e) Package number is numeric in range 1 through 999999; and (f) Packages are in ascending package number sequence.

If any validation fails, the program cancels.

PP-PRE-PROMOTE SECTION

This section is performed prior to the stringing process.

When a package is seen to have more than two hooks (unpaired book versions), then it is obvious even before attempting to string that at least one spacer will be required in that package.

Operations

If pre-promote is requested via a switch setting (either pre-promote or post-promote is allowed) then this section will alter one or more book versions within the package to save spacers.

The rule table in the system control file indicates preferences for type of promotion (e.g. version 1 to 3 rather than 1 to 2) and whether promotion should be carried out only if two spacers are saved for each promotion. (Sometimes a promotion would save only one spacer.)

Pre-promote is the default chosen over post-promote.

This section is performed 20 times for a package containing more than two hooks (if pre-promotion is a requested option).

If (a) the rule is a "C" (Change), (b) the hook count is greater that 3 or = 3 when the desired benefit is 1 spacer saved and (c) the rule permits a version change involving two of the packages's hooks (in the direction(s)) specified: then change a hook version and record the change for the package analysis report.

When a bi-directional rule is used to authorize the promotion, alternate the direction chosen to maintain an approximate balance.

AT-ACCUMULATE TOTALS

This section accumulates report totals for the print section.

Operations

This section is performed when a package has been selected for the resequence data file. It accumulates totals for the Pallet Analysis Report as produced by PT-PRINT. It accumulates (by version) the totals of original books, spacers created, bulks created, promotions into, promotions out of, and net books. Totals are kept at package, pallet or sack, and grand total levels.

EV-EXT-VERSION-PROMOTION

This section promotes a version from one package to match an unpaired version in another package (if the rule table permits it).

External promotion will generally save one spacer.

Operations

If (a) the rule is a "C" (Change), (b) the spacer saving benefit is 1, and (c) the appropriate unpaired book version is "trailing" its package, then change the book version if it is deemed useful (i.e. if it is to be changed to a version for which there is an unpaired hook of the same version in at least one remaining package).

If it is not deemed useful, and the rule specifies a bi-directional change is permissible, then check to see if a change in the other direction could be deemed useful (only feasible when there is more than one unpaired hook in the package being written).

If the version promotion takes place, add to the appropriate counts.

This section is performed only when a package has been written to the resequence file, and it has a "trailing hook" which will not be linkable with a similar hook in a remaining package.

PV-POST-VERSION-PROMOTE

Like PRE-PROMOTE, this section promotes for internal package pairing. It also can save either one or two spacers and will be obeyed if the rule table requires it.

Pre-promotion causes more promotion operations but results in fewer spacers. Post-promotion, on the other hand, requires fewer promotion operations and less run time, but causes more spacers. The customer will choose his preference or choose no version promotion at all.

Operations

If promotion would save the number of spacers specified in the chosen rule, then version promotion will take place.

Promote if there are more than two unpaired hooks in the package or there are exactly two hooks, and a saving of one spacer is permissible.

Do not promote when there are only two hooks remaining in the package unless there are other -continued

| |
|---|
| single hook packages remaining to commence the next string. (Promoting when two hooks remain will terminate the current string.)<br>Look up the rule table when promotion is deemed beneficial, to see if the customer has specified any conditions under which the promotion would be allowed.<br>If promotion takes place, accumulate all appropriate totals fields for printed reports.<br>When a bi-directional rule is used to authorize the promotion, alternate the direction chosen to maintain an approximate balance. |
| RW-RESEQUENCE-WRITE<br>Operations<br>Writes the resequence print image file. Renumbers the packages and resets the package and pallet/sack break markers. |
| CHECK STATUS<br>Check status codes after I-O activity.<br>Operations<br>This section merely checks status codes that result from a physical I/O operation to see if the requested READ or WRITE was executed as intended. The status code is the communication between the I/O software and the user-written program. |

FIGS. 6A–D show a package analysis report produced by 1-out processes of the invention. The three version types are shown as "V-01," "V-02" and "V-03." The packages shown on FIG. 6A are perfect packages as indicated by the "PP" under the "hks" or "hooks" legend in the "Package Action" column. The perfect packages end on FIG. 6C where stringing begins. As shown there, the first string begins at package 3987 which contains a version 3 trailing hook. The program pairs that hook with a leading version 3 hook in package 3988. Package 3988 contains three hooks, and the version 2 hook requires a spacer as shown under "spr" in the "Package Actions" column. The version 1 trailing hook is paired with a version 1 leading hook in package 3989. The string ends when package 3989 contains no trailing hook. Another package, 3990, begins the next string with a trailing version 3 hook which is paired with a version 3 hook from package 3991. The process continues in this manner through the end of the pallet as shown in FIG. 6D. The total number of books of each version produced for the pallet are shown in the "net totals" line of FIG. 6D.

A source code listing for a preferred form of 1-out process according to the present invention is provided as Appendices 1 and 2, which are incorporated herein by this reference as if set forth fully herein.

One-out processes of the present invention may also pair books with matching versions (before or after the books are organized into packages) and, without stringing, treat the unpaired books by, among other things, (a) upgrading the unpaired books to a higher-level postal zone (such as from carrier route to zip code, sectional carrier facility or bulk mail facility); (b) version promote the unpaired books; (c) version promote the unpaired books and add spacers or bulk books where appropriate; (d) add spacers or bulk books where appropriate; and (e) delete unpaired books. The deletion and upgrading steps may also be used with the stringing steps.

B. 2-out Processes

Two-out processes of the present invention produce a resequence data tape that permits selective binding of books on a 2-up binding and collating line in which the two output streams of books are processed and mailed separately instead of being merged into one another. As in the 1-out processes, books in the 2-out process are not transferred to another package during processing. Packages are similarly not transferred to other makeups.

Two-out processes of the present invention process two makeups simultaneously: Packages from one makeup on a first, "A," "left," or 37 leading" side are processed at the same time as packages from another makeup on the second, "B," "right," or "trailing" side. The 2-out processes rearrange packages and books within those packages in the makeup being processed on the A side so that they correspond to books within the packages in the makeup being processed on the B side. The books so rearranged on the A side match the rearranged books on the B side so that each matching A-B pair can be simultaneously manufactured on the binding and collating line.

Figure 3:
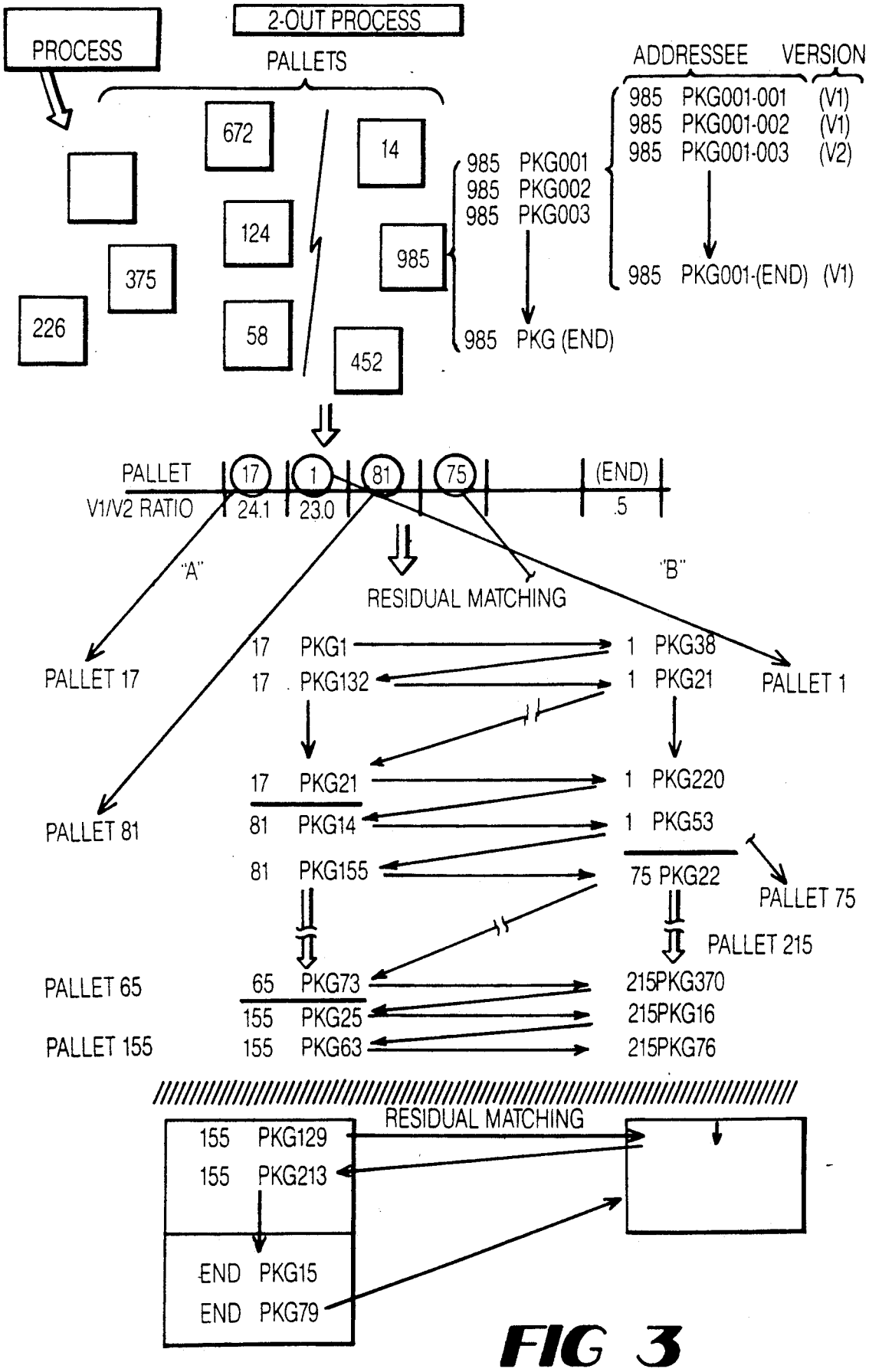
FIG. 3 is a schematic diagram showing steps of 2-out techniques and processes of the invention.

As shown in FIG. 3, 2-out processes first organize the makeups to be processed according to version ratios. Numbers of books of each version in each makeup are compared to one another to determine the version ratios. The makeups are then ordered in ascending or descending order according to version ratio. Maximum efficiency is obtained when makeups of similar version ratios are processed simultaneously on the A and B sides.

A first makeup having a high or low version ratio is selected for either the A or B side. The makeup having the next closest version ratio is then selected for the other side. As shown in FIG. 3, makeup 17 is chosen for the A side while makeup 1 is chosen for the B side.

The 2-out processes then engage in "residual matching." A first package from either the A or B side is selected for output to the resequence data file. Package 1 of makeup 17 is selected (for the A side) in the 2-out process shown in FIG. 3. The 2-out program then selects for output on the B side a package having books whose versions best match those of that A side package. If, after selecting such a package from the B side, the A side package has remaining books not matched, or "residuals," the program selects an additional package or packages from the B side until residuals appear in the package output from the B side. The program then selects a package or packages from the A side to match the B side residuals and the residual matching process continues.

During residual matching, the 2-out processes insert spacer or bulk books into either the A or B side to match otherwise unpaired books.

A simple example is as follows, in which each of three makeups contains two packages of two versions of books:

| |
|---|
| 1. Makeup 1.<br>PKG 1 - 2(V1)/3(V2)<br>PKG 2 - 1(V1)/3(V2)<br>2. Makeup 2.<br>PKG 1 - 1(V1)/3(V2)<br>PKG 2 - 13(V1)/14(V2)<br>3. Makeup 3.<br>PKG 1 - 4(V1)/4(V2)<br>PKG 2 - 6(V1)/5(V2) |

The makeup 1 version ratio is 3/6 or 0.50. The makeup 2 version ratio is 14/17 or 0.82. The makeup 3 version ratio is 10/9 or 1.11. Makeup 1, which has the lowest ratio, is selected for the A side and makeup 2, having the next closest ratio, is selected for the B side. Package 1 from makeup 1 is selected for output. The program then selects package 2 from makeup 2. Two V1's and 3V2's of makeup 2, package 2 are used to match makeup 1, package 1, and the other 11 V1's and 11 V2's are residuals. The program then selects and outputs makeup 1, package 2 to match the B side residuals, leaving 10 V1 and 8 V2 B side residuals. Because all packages from makeup 1 have been residual matched and output, the program selects makeup 3 for A side processing. Makeup 3, package 1, and then makeup 3, package 2 are selected and outputted to match remaining B side residuals. A spacer version 1 must be inserted into makeup 3, package 2 to match the otherwise unpaired remaining B side V1 residual. One V1 and 1 V2 residual then appear on the A side. The remaining package on the B side, makeup 2, package 1, however, contains 1 V1 and 3 V2's. The program adds two spacer V2's to makeup 3, package 2 to complete the process.

At end of data (or at end of other desired breakpoint), if either side A or side B has no more books available to pair with the remaining packages of the makeup on the other side, then those remaining packages may be divided between side A and side B.

Figure 7:
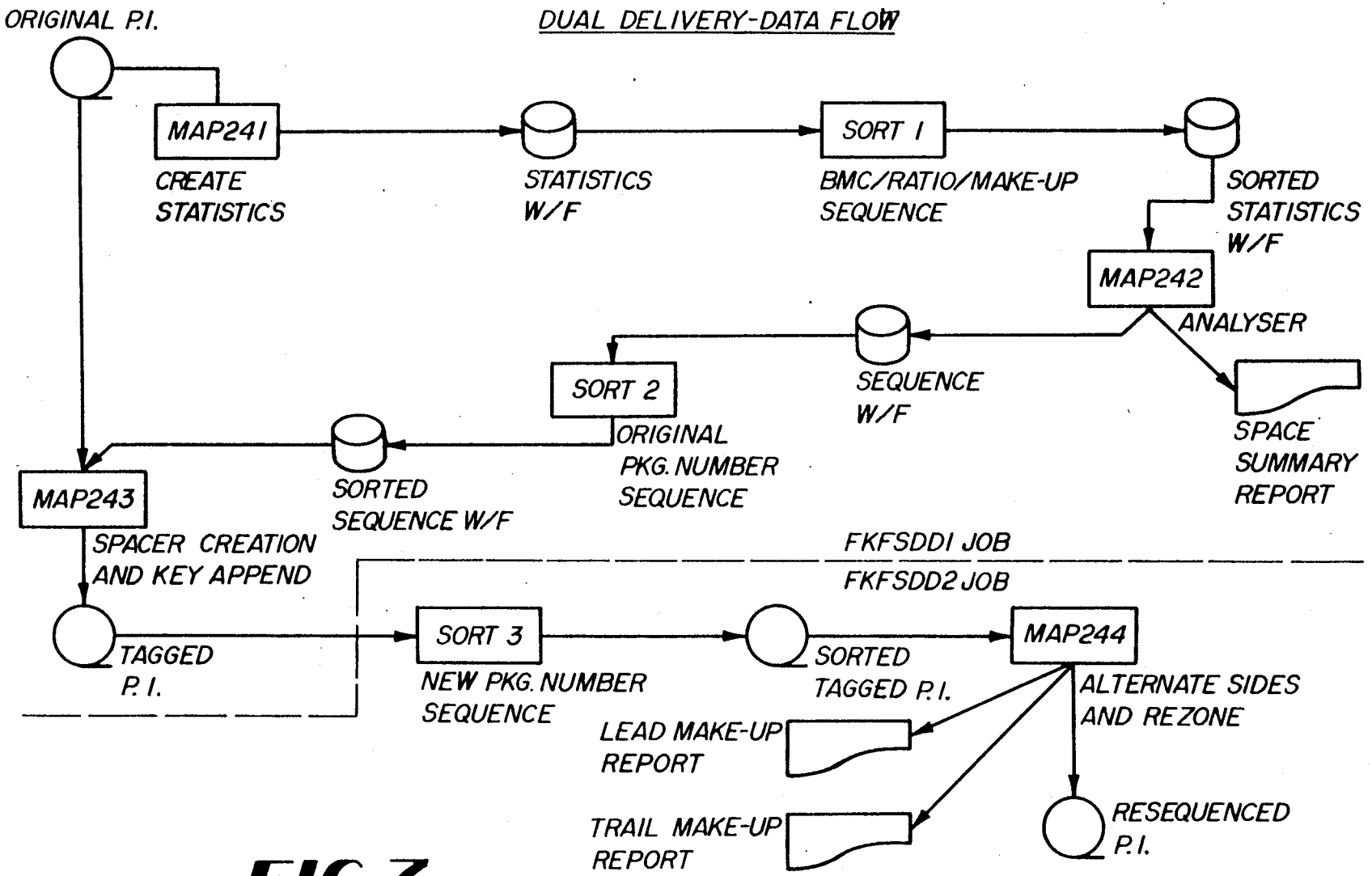
FIG. 7 is a flow chart of 2-out techniques and processes of the present invention.

FIG. 7 is a flow chart showing in more detail a preferred 2-out process according to the present invention. Briefly, a program entitled MAP241 reads the original print image file and writes a statistics work file which includes BMC, makeup and version ratio information for each makeup. A program entitled SORT-1 sorts the statistics work file according to BMC, ratio and makeup. The sorted statistics work file is then operated on by program MAP242. MAP242 analyzes the sorted statistics work file and creates a sequence file. The program places the statistics records for a first makeup into a lead side core table and statistics records for a second makeup into a trail side core table. The program then selects packages from each core table by residual matching. The program writes records of the selected packages to the sequence file, designating the original package number, the side that the package is allocated to and the new package sequence number as well as spacer counts for each package. A program entitled SORT-2 then sorts the sequence work file according to original package number. A program entitled MAP243 uses the statistics in the sorted sequence work file, which are ordered in the same order as the print image file, to operate on the print image file. The MAP243 program tags each record in the print image file with a lead or trail indicator and the new sequence number of the package according to the information reflected in the sorted sequence work file. The MAP243 program also creates spacer records for packages in the print image file corresponding to spacer counts shown in the sorted sequence work file.

A program entitled SORT-3 sorts the tagged book records in the print image file into the sequence required for version pairing. It also ensures that spacer records will appear ahead of other normal records in the package in order to prevent spacer records from appearing at the end of a package. A program entitled MAP244 creates a new resequenced print image file which contains pairs of records of like versions. The program also marks the last record in each package and the last in each makeup so that the binding and collating line properly collates and straps the correct packages.

The following description discloses steps performed by the programs mentioned above and shown in FIG. 7.

MAP241

The MAP241 program reads the original print image file and prepares a statistics work file. The statistics work file includes the following information for each makeup:

(1) BMC, comprising 2 numeric bytes;

(2) MAKEUP TYPE, comprising 1 alphabetic byte--"P" for pallet or "S" for sack;

(3) MAKEUP NUMBER, comprising 5 numeric bytes;

(4) MAKEUP RATIO, comprising 4 numeric bytes (with two decimal places); and (5) 20 blocks of package description, each block containing:

(a) PACKAGE NUMBER, comprising 6 numeric bytes;

(b) BOOKS-IN-PACKAGE, comprising 3 numeric bytes; and (6) VERSION 1 BOOKS-IN-PACKAGE, comprising 3 numeric bytes.

Makeups having more than 20 packages are defined by more than one such record.

The MAP241 program creates the statistics work file by first building a core table for the makeup being read from the original print image file. The core table contains counts for up to 800 packages. When a change of makeup is detected, the core table is utilized by the MAP241 program to write the statistics work file records.

SORT-1

The SORT-1 program sorts the statistics work file into sequence according to BMC, ratio, makeup number and then makeup type.

MAP242

The MAP242 program analyzes the sorted statistics file produced by SORT-1 and determines the best sequence for packages. The MAP242 program loads makeups according to the sequence selected by the SORT-1 program. The MAP242 program places the statistics records for the first makeup in the "A" or lead side core table and the statistics records for the second makeup in the "B" or trail side core table. The program then selects packages for each side based on the packages remaining in the makeup, according to residual matching. When all packages for a makeup are selected, the next makeup in ratio sequence is selected for residual matching and its statistics will be read into the empty side's core table.

Whenever it selects a package, MAP242 writes a record to the sequence file, with the following data:

(1) ORIGINAL PACKAGE NUMBER, comprising 4 binary bytes;

(2) SIDE PACKAGE ALLOCATED TO, comprising 1 numeric byte (1=LEAD; 2=TRAIL);

(3) NEW PACKAGE SEQUENCE NUMBER, comprising 4 binary bytes;

(4) Version 1 Spacer Count for PACKAGE, comprising 3 numeric bytes; and (5) Version 2 Spacer Count for PACKAGE, comprising 3 numeric bytes.

The MAP242 program additionally produces a summary report which includes the total number of spacer books to be produced. This report can be utilized to determine whether to proceed with the 2-out process or to run the 1-out process instead.

Various sections of the MAP242 program perform the following steps:

CONTROL SECTION (a) Maintains high level control of the program;
(b) Opens files;
(c) Initializes data fields;
(d) Performs SPLIT PROCESS section until the last SPLIT (BMC) is finished;
(e) Writes final held records;
(f) Performs ANALYSIS REPORT section; and
(g) Closes files.

ANALYSIS REPORT SECTION (a) Print the Spacer Summary Report.

SPLIT PROCESS SECTION (a) Selects packages for indicated side until split is finished;

(b) If a makeup has finished but the split has not—perform PULL-IN-A-MAKEUP section; and (c) At the end of SPLIT divides remaining un-used packages between the sides and continues selecting packages, continuing to divide the remainder when one side runs out.

PACKAGE SELECTION

Package statistics for each side are held in a pair of core tables. The core table for the lagging side (that side which has had fewer books assigned to date) is scanned to find an available package.

The following is the hierarchy of selection preferences:

(1) Any package which has enough Version 1 and Version 2 books to satisfy the opposite side's already allocated books. For example, if the lead side had been allocated fifteen more V1 books and seven more V2 books than the trail side, then the first preference package would be one which contained at least fifteen V1 books and at least seven V2 books. This package would satisfy the need and then swap the onus to the other side to provide a suitable package. No spacers need to be created.

(2) If no preference 1 packages are available, then a preference 2 package is used when possible. A preference 2 package fails to satisfy the deficit in one version and either fails to satisfy or only just satisfies the deficit of the other version. It can be used, and then another package can be selected for the same side. No spacers need be created. This is the technique of combining small packages on one side to match up with a larger package on the other.

(3) As a last resort a preference 3 package will be used. It is a package which more than satisfies the deficit in one version but fails to satisfy the deficit in the other version. Spacer books must be created in this package. The preference 3 package which would require the fewest spacers to be created will be the one used.

PULL-IN-A-MAKEUP SECTION (a) Load the package statistics for the next makeup into the core table for the indicated side (lead or trail).

(b) Reset the book version counts for that side.

WRITE SEQUENCE SECTION (a) Build a record for the sequence work file.
(b) Write the held record (one record per package).

DIVIDE-A-SIDE SECTION (a) Calculate how many packages should be transferred to the other side.

(b) Move the calculated number of package statistics to the other side.

(c) Reset the statistics for each side.

SORT-2

The sort-2 program sorts the sequence work file into original package number sequence so that the MAP243 program can more easily correlate the statistics in the sequence work file to the records in the print image work file, which are ordered according to original package number. The record layout for the sequence work file is:

(1) ORIGINAL PACKAGE NUMBER, comprising 8 numeric bytes;

(2) SELECTED SIDE, comprising 1 numeric byte (1=LEAD; 2=TRAIL);

(3) NEW PACKAGE SEQUENCE, comprising 8 numeric bytes;

(4) Version 1 spacers needed for this PACKAGE, comprising 3 numeric bytes; and (5) Version 2 spacers needed for this PACKAGE, comprising 3 numeric bytes.

MAP243

The MAP243 program appends a tag to each record of the print image file according to information obtained from the sequence work file. It also creates the specified number of spacer records for each package in the print image file according to information in the sequence work file. The MAP243 program operates according to the following steps:

(1) For each record on the print image file, the program finds the record on the sequence work file whose original package number corresponds with the package number on the print image record.

(2) The program appends a tag to the print image record and writes that tagged record to the output file. The tag consists of a lead or trail indicator and the new package sequence number of the package in which the record belongs.

(3) The program creates, for each package, the number of spacer records indicated by the sequence work file. Spacer records have tags identical to those on other records of the package in which they are placed.

SORT-3

The SORT-3 program sorts tagged book records into the sequence required for version pairing. The sort ensures that spacer records (when present) appear ahead of the normal records of the package, in order to prevent a spacer record from appearing as the last book in a package. The spacer would otherwise be diverted at the end of the package, so that its package break indicators would be ignored during the binding and collating process.

MAP244

The MAP244 program creates a new resequenced print image file from the sorted and tagged original print image file. The resequenced print image file contains pairs of records of like version that correspond to the packages that will be delivered simultaneously on the "A" and "B" sides of the binding and collating line. Odd numbered books will be on the lead side while even numbered books will be on the trail side.

The MAP244 program also prints the lead and trail detailed analysis reports.

The following steps are performed by the MAP244 program:

(1) Read a package of records into a core table for the lead side, separating the version 1 and version 2 records.

(2) Read a package of records into a core table for the trail side, separating the version 1 and version 2 records.

(3) Select a pair of records, one from the lead table and one from the trail table and write them to the new resequence print image file. Delete the records from the core tables.

(4) Repeat step (3) until there are no more pairs which can be written. At this point either the lead table or the trail table is empty.

(5) Refill the empty core table by repeating either step (1) or (2). Continue from step (3).

The foregoing is provided for purposes of explanation and illustration. Modifications may be made to the processes disclosed herein without departing from the scope or spirit of the invention.

What is claimed is:

1. A process for manufacturing a plurality of versions of books simultaneously from a plurality of data records, which books are to be packaged according to makeup (corresponding to the units in which the books are packaged) and package (corresponding to the postal zone to which each book is addressed) comprising the steps of:

(a) obtaining a plurality of data records, at least one of each of which records contains information regarding at least one book;

(b) sorting information from each record to organize the information into a plurality of groups so that (1) for substantially all of the records, the version of each record at any position in the sequence of records in one group corresponds to the versions of each record at a like sequential position in the other groups, but (2) the records for each makeup appear in the same group and records are not sequenced out of their package;

(c) forming the books simultaneously in the groups utilizing the sorted information; and (d) organizing and packaging the books according to their makeups and packages.

2. A process according to claim 1 in which two versions of books are manufactured simultaneously in two groups.

3. A process for simultaneously manufacturing at least two versions of books from a data file that contains at least one record for each book, such record including the book's makeup (corresponding to the unit in which the book will be packaged), the book's package (corresponding to a zone included in the makeup) and the version of the book, including the following steps:

(a) creating a statistics file which contains at least one record that corresponds to each record in the data file, and which statistics file records note the sequence of the corresponding data file record in the data file, the makeup and package of the corresponding data file record and the version of the book to be produced according to the data file record;

(b) sorting the statistics file into two groups so that (1) for substantially all of the records, the version of each record at any position in the sequence of records in the first group corresponds to the version of each record at a like sequential position in the second group; but (2) the records for each makeup appear in the same group and records are not sequenced out of their package;

(c) noting the group and the sequence in that group of each sorted statistics file record;

(d) resorting the statistics file to sequence the records according to their sequence in the data file;

(e) correlating each record in the data file with its corresponding record in the resorted statistics file to annotate each record in the data file with the group and sequence within the group of the corresponding statistics file record;

(f) sorting the data file according to the group and sequence within the group of each record;

(g) forming the books simultaneously in pairs utilizing the records in the sorted data file; and (h) organizing and packaging the books according to their makeups and packages.

4. A process according to claim 3 in which two versions of books are manufactured simultaneously.

5. A process according to claim 3 for manufacturing two versions of books simultaneously and in which the step of sorting the statistics file into two groups further comprises the steps of:

(a) ordering the makeups in the statistics file according to ratios of book versions in each makeup;

(b) selecting a first makeup according to version ratio and assigning the makeup to a first table corresponding to one of the groups;

(c) selecting a second makeup according to version ratio and assigning the makeup to a second table corresponding to the other group;

(d) selecting a package from one table and selecting a package from the other table whose book versions best match the book versions of the package just selected;

(e) forming pairs of matching-version records from the two tables until unpaired residual records appear in one of the packages;

(f) selecting at least one package from the table which is not the source of the package having residuals, which at least one package has versions that correspond to the versions of the residuals in the other package;

(g) pairing unpaired records with blank records whose versions match the unpaired records;

(h) repeating steps (e) through (g) until records in one makeup have been depleted;

(i) selecting a makeup from the statistics file according to version ratio and assigning the makeup to the depleted table;

(j) repeating steps (d) through (i) until all makeups have been processed; and (k) if either table contains unpaired packages:

(i) selecting and transferring at least one of said unpaired packages to the other table; and (ii) repeating steps (e) through (g) until records in one table have been depleted; and (1) repeating step (k) until no unpaired packages remain.

6. A process according to claim 5 in which the step of selecting at least one package from the table which is not the source of the package having residuals is accomplished according to the following hierarchy of preference:

(a) a package which has sufficient first and second versions to exceed the other package's residuals of each version;

(b) a package which contains an insufficient number of first and second versions to match the other package's residuals, or contains an insufficient number of one version to match the other package's residuals of that version and a sufficient number of the other version to equal the other package's residuals of that version; and (c) a package which contains an insufficient number of one version to match the other package's residuals of that version, but a sufficient number of the other version to exceed the other package's residuals of that version.

7. A process according to claim 6 in which the step of selecting a preference III package further comprises the step of selecting the preference III package that requires the fewest blank records to be inserted in order to match records.

8. A process according to claim 5 in which at least one blank record corresponds to a spacer.

9. A process according to claim 5 in which at least one blank record corresponds to a bulk book.

10. A process according to claim 5 further comprising the step of creating a blank record report after the step of sorting the statistics file into two groups, which blank record report includes the total number of spacer and bulk books to be produced.

11. A method for collating and binding a plurality of books addressed to at least two sets of addressees, each set to receive a different version of the books, comprising the steps of:

(a) obtaining a plurality of data records corresponding to the addressees, each of which records is classified within:

(1) a makeup, corresponding to a pallet or sack in which the book corresponding to the record will be shipped; and (2) a package, corresponding to the postal zone of the record's addressee;

(b) creating a statistics work file, containing, for each makeup:

(1) identifying information for the makeup;

(2) ratios of the versions of books to be produced by records in the makeup; and (3) for each package in the makeup:

(x) identifying information for the package;

(y) number of records in the package; and (z) number of at least one version of the records;

(c) entering information for a first makeup from the statistics work file into a first table that corresponds to a first side of the collating and binding line;

(d) entering information for a second makeup from the statistics work file into a second table that corresponds to a second side of the collating and binding line;

(e) selecting a package from the first table;

(f) selecting at least one package from the second table whose records match, as closely as possible, the versions of the records in the package in the first table;

(g) forming pairs of matching-version records from the two packages until unmatched records remain in one of the packages;

(h) selecting at least one package from the table not having a selected package with unmatched records, whose records match, as closely as possible, the versions of the unmatched records of the selected package with remaining unmatched records;

(i) adding spacer counts for unmatched records;

(j) whenever a table is depleted, entering information for a next makeup from the statistics work file into that table;

(k) repeating steps (g) through (j) until all packages are selected;

(l) creating a sequence work file, containing for each version-matched and selected package:

(1) the original package number of the package;

(2) the side of the collating and binding line to which the package is allocated;

(3) the new package number of the package as a result of the selection;

(4) the count for each version of records in the package; and (5) spacer counts for the package;

(m) using the information in the sequence work file to append to each data record a tag comprising information for:

(1) the side of the collating and binding line to which the record is allocated; and (2) a new sequence number for the record;

(n) using the information in the sequence work file to create spacer records;

(o) resequencing the data records according to their new sequence numbers into pairs of records of like versions;

(p) forming the books simultaneously in pairs utilizing the resequenced data records; and (q) organizing and packaging the books into zone packages.

12. The method of claim 11 further comprising the step of sorting the statistics work file to sequence the makeups according to version ratio and in which information for makeups is entered into the tables according to version ratio.

13. The method of claim 11 further comprising the step of sorting the sequence work file to organize the information in the file according to original package number.

14. The method of claim 11 in which the data records are resequenced so that bulk records will not fall at the ends of packages.

15. The method of claim 11 further comprising the steps of dividing the unmatched records of the last selected package, sending the divided portion to the table not containing the last selected package, and matching the versions of the remaining records.

* * * * *